US008037641B2

(12) United States Patent
Gerig

(10) Patent No.: US 8,037,641 B2
(45) Date of Patent: Oct. 18, 2011

(54) GUTTER GUARD

(75) Inventor: Ronald L. Gerig, Pettisville, OH (US)

(73) Assignee: Grater Gutter Guard LLC, Pettisville, OH (US)

( * ) Notice: Subject to any disclaimer, the term of this patent is extended or adjusted under 35 U.S.C. 154(b) by 308 days.

(21) Appl. No.: 12/456,646

(22) Filed: Jun. 19, 2009

(65) Prior Publication Data

US 2009/0320381 A1 Dec. 31, 2009

Related U.S. Application Data

(60) Provisional application No. 61/133,324, filed on Jun. 27, 2008.

(51) Int. Cl.
*E04D 13/00* (2006.01)

(52) U.S. Cl. ..... 52/12; 210/155

(58) Field of Classification Search ..... 52/11, 12; 210/155, 163–166
See application file for complete search history.

(56) References Cited

U.S. PATENT DOCUMENTS

| | | | | | |
|---|---|---|---|---|---|
| 2,271,081 | A * | 1/1942 | Layton | 52/12 |
| 3,388,555 | A * | 6/1968 | Foster | 405/119 |
| 4,036,761 | A | 7/1977 | Rankin | |
| 4,404,775 | A * | 9/1983 | Demartini | 52/12 |
| 4,418,504 | A * | 12/1983 | Lassiter | 52/12 |
| 4,467,570 | A * | 8/1984 | Kriegel | 52/12 |
| 4,616,450 | A * | 10/1986 | Shouse | 52/12 |
| 4,631,875 | A * | 12/1986 | Olson | 52/12 |
| 4,727,689 | A * | 3/1988 | Bosler | 52/12 |
| 4,876,827 | A * | 10/1989 | Williams | 52/12 |
| 5,271,191 | A * | 12/1993 | Vahamaki | 52/12 |
| 6,009,672 | A * | 1/2000 | Kuhns | 52/13 |
| 6,151,837 | A * | 11/2000 | Ealer, Sr. | 52/12 |
| 6,536,165 | B2 * | 3/2003 | Pilcher | 52/12 |
| 6,883,760 | B2 * | 4/2005 | Seise, Jr. | 248/48.1 |
| 7,104,012 | B1 | 9/2006 | Bayram | |
| 7,143,549 | B2 | 12/2006 | Brochu | |
| 7,198,714 | B2 | 4/2007 | Swistun | |
| 7,310,912 | B2 | 12/2007 | Lenney et al. | |
| 7,347,027 | B2 | 3/2008 | McDonald et al. | |
| 7,765,742 | B2 * | 8/2010 | Ealer, Sr. | 52/12 |
| 2001/0017008 | A1 * | 8/2001 | Kuhns | 52/11 |
| 2008/0000169 | A1 * | 1/2008 | Handley | 52/12 |
| 2010/0071273 | A1 * | 3/2010 | Joly et al. | 52/12 |

* cited by examiner

*Primary Examiner* — Robert Canfield
*Assistant Examiner* — Brent W Herring
(74) *Attorney, Agent, or Firm* — Emch, Schaffer, Schaub & Porcello Co., L.P.A.

(57) ABSTRACT

A gutter guard for preventing the entrance of debris into the trough of a gutter includes an outwardly convex portion extending lengthwise over the trough of the gutter. A plurality of hoods extend upwardly from the outwardly convex portion and over lie a first set of apertures. The upwardly extending hoods direct water flowing over the convex portion through the first set of apertures. A second set of apertures outwardly from the first set of apertures has downwardly extending hoods underlying, such downwardly extending hoods deflecting water on the inner surface of the outwardly convex portion.

12 Claims, 2 Drawing Sheets

GUTTER GUARD

CROSS REFERENCE TO RELATED APPLICATION

The present application is based upon and claims the benefit of U.S. provisional patent application No. 61/133,324 filed Jun. 27, 2008.

The present invention is directed to a gutter guard which prevents or retards leaves and other debris from entering the gutter and clogging the gutter system.

BACKGROUND OF THE INVENTION

Gutter guards of various types and designs have been used for many years in an attempt to prevent leaves and other debris from entering the main trough of the gutter and obstructing such gutters and downspouts extending therefrom. Examples of prior art gutter guards or screens include the following U.S. Pat. Nos. 7,198,714; 7,143,549; 7,104,012; 4,036,761.

Many prior art gutter guard systems utilize round or slotted holes which are perforated through the upper surface of the gutter guard. During periods of heavy rain, such round or slotted holes are unable to receive therethrough all of the water flowing down the roof and into the gutter. As a result, a significant amount of water will pass over the holes across the upper surface of the gutter guard and flow over the upper edge of the gutter and onto the ground below and, therefore, not be directed to the trough of the gutter and the downspout connected thereto.

SUMMARY OF THE INVENTION

The gutter guard of the present invention is provided with unique water entrance hole designs having cup-shaped hoods adjacent the entrance holes to direct the water into the trough of the gutter. Water flowing on the upper surface of the gutter guard will be directed downwardly into the gutter while, on the other hand, water flowing along the undersurface of the gutter guard (and retained thereon by surface tension between the water and such undersurface) is directed downwardly into the channel of the gutter by means of downwardly extending cup-shaped hoods formed in rows adjacent the apertures near the outer edge of the gutter and in a position downwardly from the maximum elevation at the center of the gutter guard. With such construction, water retained on the lower surface as a result of water tension will be directed into such cup shaped protrusions or hoods and into the gutter itself. Preferably the cup shaped protrusions/hoods of one row are disposed in a staggered relationship with respect to the cup shape protrusions/hoods in an adjacent row.

The gutter guard of the present invention is designed to be installed onto gutters at the lower edges of new or existing shingle or other style roofs. It may be installed by inserting the edge of the guard closest to the house under the bottom edge of the lower course of roof shingles and the outer portion of the guard onto the outer lip of the gutter. Alternatively, a flange portion, for example one inch (plus or minus) adjacent the house, may be folded to a position such that it may be joined by nails or screws to a vertical wall of a house or other structure adjacent the lower edge of the roof or to a vertical wall of the gutter assembly. Following engagement of the guard to the gutter outer lip, the guard is positioned to direct the rain water through the perforated surface and into the trough of the gutter.

When installed, the gutter guard provides protection from dirt and debris from entering the gutter, filling and clogging the gutter system while receiving high quantities of rain water flow.

The high capacity efficiency of the gutter guard of the present invention is a direct result of its unique water entrance hole design. The gutter guard hole design is dimpled out or raised forming (a) on the upper side a plurality of upwardly extending rows of hoods each with an open side facing the direction of the oncoming rain water and (b) on the lower side a plurality of downwardly extending rows of hoods to direct water flowing on the undersurface of the gutter guard into the trough of the gutter. This design with the overlap staggered pattern proves itself to be very efficient because of its added flow resistance directing the water downward into the gutter below. At the same time this design adds high surface energy to the cover it also channels the water into the gutter below.

With this combination, the water flow direction, surface energy and gravity draw, the gutter guard of the present invention is capable of effectively collecting even the highest flow of rain water.

Debris deflection: The hole design, and layout pattern provides the additional benefit of deflecting debris from lodging in the openings because the holes are essentially covered by the "hood like" hole perforations. This self cleaning feature is further enhanced by a combination of wind, surface as well as upward thru-flow drying and moving the debris along with gravity forcing these materials off of the cover.

Hole pattern enhancement: By reversing the direction of the perforations to form downwardly extending cup-shaped hoods for the bottom 2 or 3 rows, those closest to the gutter lip, the gutter guard allows any water that flows on the lower surface of the guard to be directed into the gutter. In addition, it allows for ice and snow to melt and fall back into the gutter rather than flowing off the front of the gutter lip.

Curved surface advantage: The gutter guard of the present invention has a surface which is arched upwardly, away from the trough of the gutter thereby providing pressure between the roof and the gutter lip. This serves as an advantage because the pressure causes the gutter guard to firmly seat against the gutter lip upon installation.

Other objects and advantages of the present invention will become apparent to those skilled in the art upon a review of the following detailed description of the preferred embodiments and the accompanying drawings.

DETAILED DESCRIPTION OF THE INVENTION

Figure 2:
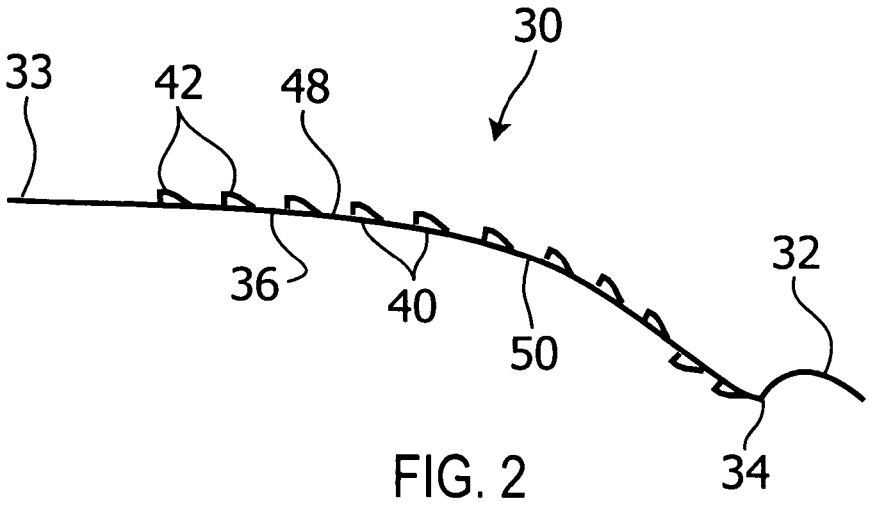
FIG. 2 is a schematic view of the gutter guard of the present invention as manufactured.

Referring to the drawings, there is shown a gutter assembly 10 having a rear wall 12 intended for attachment to the house or other structure in a position underlying the edge the roof shingles 14 of the house. The gutter assembly also includes a lower or bottom wall 16 and a contoured front wall 18 extending upwardly and outwardly to an upper lip 20. The foregoing elements of the gutter assembly define a trough 22 for receiving rain water draining from the roof 14 and flowing over the roof edge.

Figure 1:
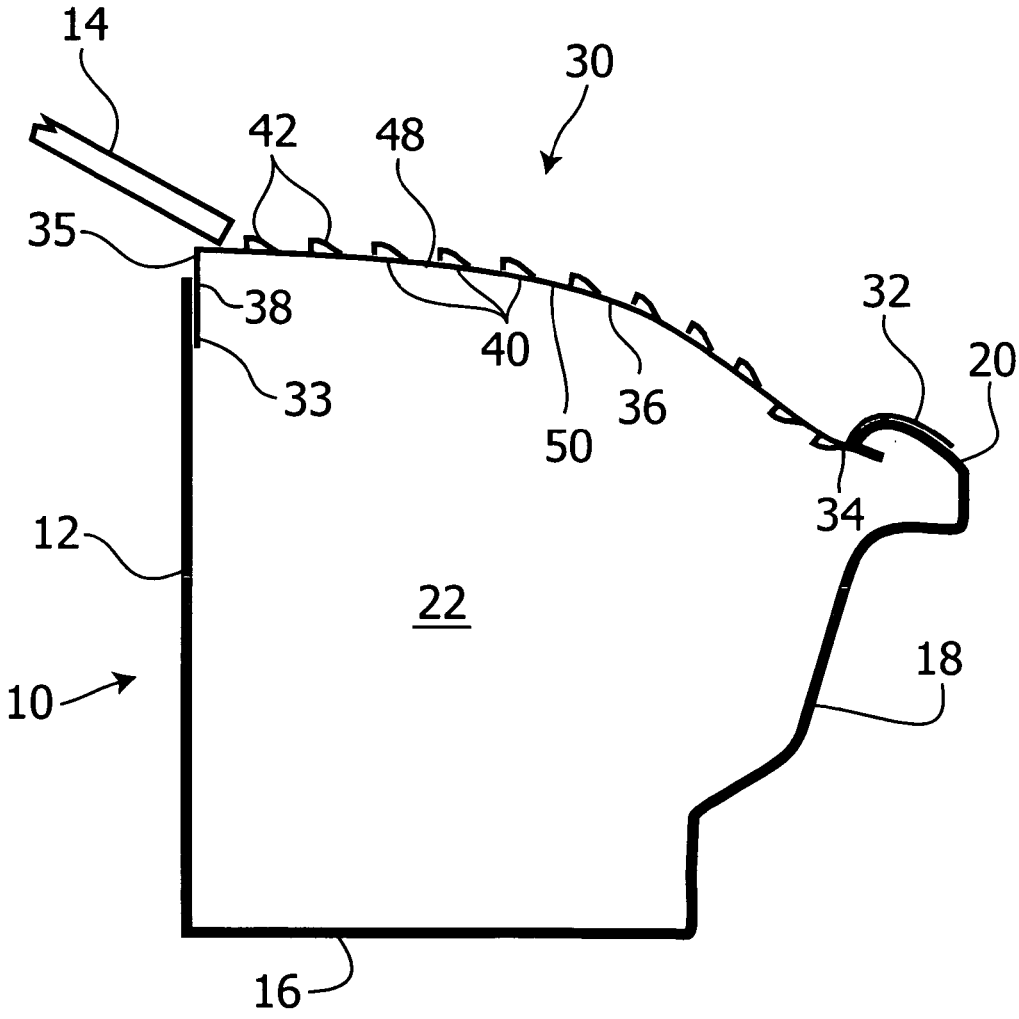
FIG. 1 is a schematic view showing a gutter trough assembly with the gutter guard of the present invention secured thereto.

Secured to the gutter assembly 10 shown in FIG. 1 is a gutter guard 30 of the present invention. The gutter guard 30 may be stamped or formed from a metal sheet or a resilient stiff plastic. It may have an indeterminate length intended to span the length of the gutter assembly 10 to which it is attached and a width extending from a lip 32 intended to overlie and be engaged to the lip 20 of the gutter assembly to an attachment end 33. The gutter guard follows a curved path from said lip 32, initially slightly downwardly from the lip 32 to a lowermost portion 34 defining a shoulder, and thereafter angled upwardly following an outwardly convex path 36 to the attachment end 33.

FIG. 2 shows the gutter guard 30 in its "as manufactured" form with attachment end 33 extending along a straight line from the convex path 36. In the "as manufactured" form, the attachment end 33 can be slipped beneath the roof shingles 14 and nailed to the roof of the house or other structure. Alternatively, as shown in FIG. 1, the attachment end 33 may be bent along a hinge line 35 to form a downwardly turned tab or flange 38 for attaching to the rear wall 12 of the gutter assembly 10 or to the side of the house or other structure.

Figure 3:
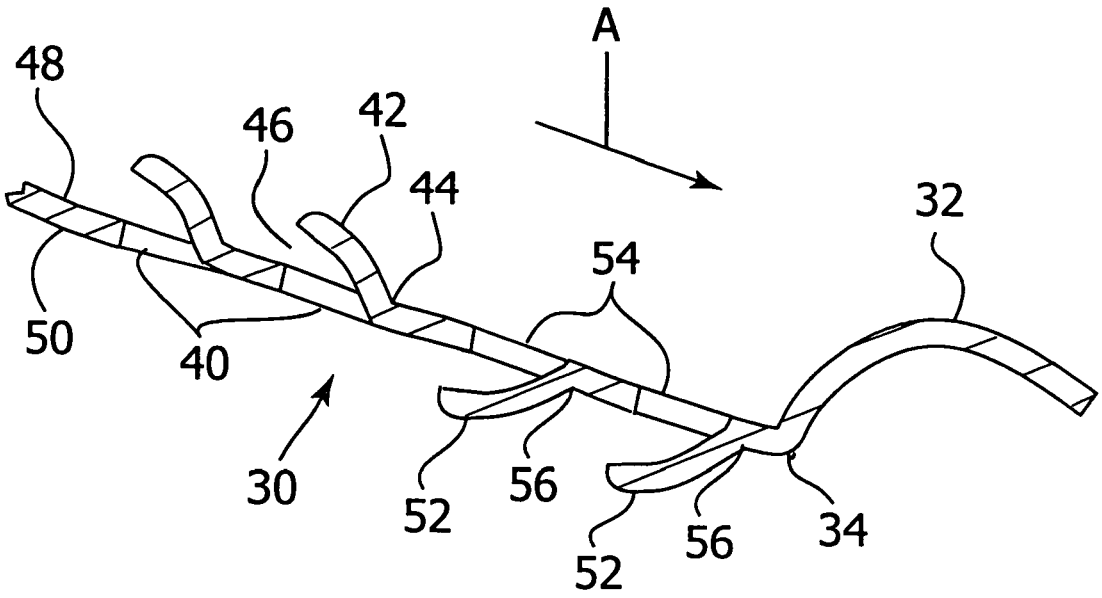
FIG. 3 is a fragmentary sectional view of that portion of the gutter guard of the present invention intended to be positioned adjacent the outer lip of the gutter.

The outwardly convex portion 36 has a series of rows of apertures 40 which, upon being formed by stamping of the metal or plastic sheet, define a series of hoods 42 extending upwardly from the outwardly convex path 36. As shown most clearly in FIG. 3, the hoods 42 thus define a closed end 44 downwardly from the direction of the flow of the water as indicated by the arrow A in FIG. 3. The hoods 42 thus define openings 46 for receiving water from the upper surface 48 of the gutter guard 30, which water is deflected by the hoods 42 and into the apertures 40 leading to the trough 22.

As will be appreciated, as water flows through the apertures 40, a portion of the water will be splashed upon and flow down on the lower surface 50 of the gutter guard 30, being retained thereon by surface tension between the water and such lower surface 50. In order to prevent water flowing down such lower surface 50 from spilling over the lip 20 of the gutter assembly 10, there is provided two sets of rows of downwardly extending hoods 52, the stamping of which forms apertures 54. If desired, there could be more rows of downwardly extending hoods 52. The hoods 52 define closed ends 56 which will deflect water running down the lower surface 50 and force it into the trough 22.

Figure 4:
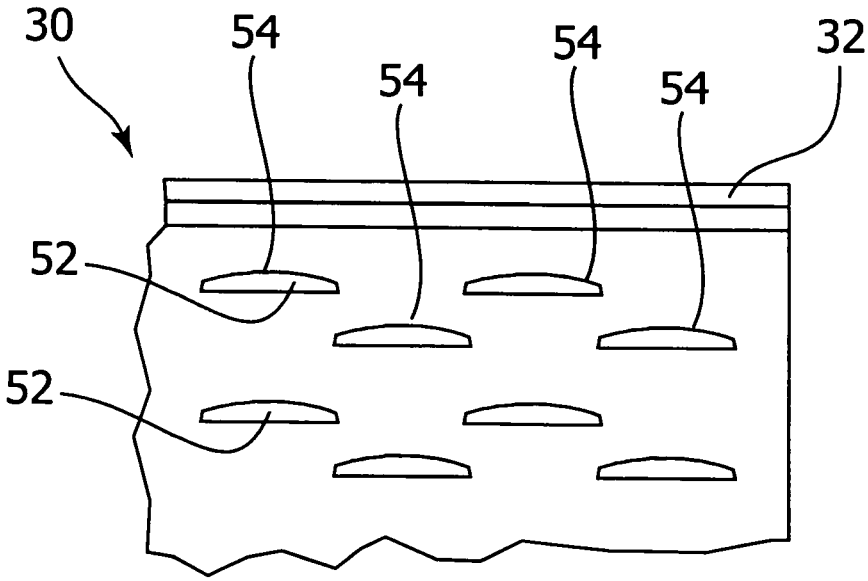
FIG. 4 is a fragmentary top plan view of that portion of the gutter guard intended for fastening to the outer gutter lip.

As shown in FIG. 4, preferably the hoods 52 of one row of apertures 54 are disposed in a staggered relationship (in the direction A of water flow) with respect to the hoods 52 of the adjacent rows of apertures 54.

Although the lip 32 of the gutter guard may be screwed or otherwise fastened to the upper lip 20 or similar outer portion of the gutter 10, it can also be simply frictionally retained against the inner surface of the outer portion of the gutter 10 by squeezing or otherwise displacing the lowermost portion 34 toward the hinge line 35 during installation. When in position with the lowermost portion 34 in contact with the inner surface of the outer portion of the gutter 10 (inwardly from the upper lip 20 as shown in FIG. 1), release of such squeezing pressure will permit the lowermost portion 34 to "spring back", resiliently urging such lowermost portion 34 against such inner surface due to the combination of the outwardly convex portion 36 and the resilience of the metal or plastic from which the gutter guard 30 was formed.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A gutter guard attachable to a gutter of a structure, said gutter having a trough, said guard preventing or retarding the entrance of debris or other solids into said trough while permitting the entrance of water into said trough comprising:

(a) an outwardly convex portion extending lengthwise over said trough and transversely from an area at or near said structure outwardly therefrom;

(b) a plurality of hoods extending upwardly from said outwardly convex portion, said hoods overlying a first set of apertures and directing water flowing over said outwardly convex portion through said first set apertures and into said trough; and (c) a plurality of downwardly extending hoods underlying a second set of apertures for deflecting water on the inner surface of said outwardly convex portion into said trough.

2. A gutter guard according to claim 1 wherein said second set of apertures are spaced further from said structure than said first set of apertures.

3. A gutter guard according to claim 1 wherein the apertures of said first set of apertures are aligned to define a plurality of rows extending lengthwise.

4. A gutter guard according to claim 3 wherein the apertures of said second set of apertures are aligned to define at least one row extending lengthwise and positioned outwardly from at least some of the rows of said first set of apertures.

5. A gutter guard according to claim 4 wherein the apertures of alternate rows of said first set are so positioned in a transverse direction as to define first transversely aligned rows and the rows of apertures of alternating lengthwise rows define second transversely aligned rows, said first transversely aligned rows being offset from said second aligned transverse rows.

6. In combination:

(a) a gutter attached to a structure for draining water therefrom, said gutter having a trough with a bottom, a rear portion upwardly from said bottom attached to said structure and a front portion upwardly from said bottom and spaced outwardly from said structure; and (b) a gutter guard engaged to said gutter for preventing or retarding the entrance of debris or other solids into said trough while permitting the entrance of water into said trough, said gutter guard including:

(i) an outwardly convex portion extending lengthwise over said trough and transversely from said rear portion to said front portion, (ii) a plurality of hoods extending upwardly from said outwardly convex portion, said hoods overlying a first set of apertures and directing water flowing over said convex portion through said first set apertures and into said trough; and (iii) a plurality of hoods extending downwardly from said outwardly convex portion and underlying a second set of apertures for deflecting into said trough water on the surface of said outwardly convex portion facing said bottom.

7. The combination according to claim 6 wherein said second set of apertures is located closer to said front portion than said first set of apertures.

8. The combination according to claim 6 wherein the apertures of said first set of apertures are aligned to define a plurality of rows extending lengthwise.

9. The combination according to claim 8 wherein said the apertures of said second set of apertures are aligned to define at least one row extending lengthwise and positioned closer to said front portion than least some of the rows of said first set of apertures.

10. The combination according to claim 9 wherein the apertures of alternate rows of said first set are so positioned in a transverse direction as to define first transversely aligned rows and rows of apertures of alternating lengthwise rows and define second transversely aligned rows, said first transversely aligned transverse rows being offset from said second transversely aligned rows.

11. The combination according to claim 6 wherein said gutter guard is formed of metal, plastic or other resilient material and has (1) an inner lengthwise extent engaged to said structure or said gutter rear portion and (2) an outer lengthwise extent engaged to said gutter front portion.

12. The combination according to claim 11 wherein the retention of said gutter guard to said gutter front portion is effected by pressure exerted thereagainst by said outwardly convex portion as a result of displacement of said outer lengthwise extent toward said inner lengthwise extend during engagement of said gutter guard to said gutter.

* * * * *